United States Patent [19]

Swenson et al.

[11] 4,394,784

[45] Jul. 26, 1983

[54] AIR BED WITH FIRMNESS CONTROL

[75] Inventors: Gerald R. Swenson; Emil S. Swenson, both of Coon Rapids; Gary A. Young, Burnsville, all of Minn.

[73] Assignee: Dial-A-Firm International, Inc., Burnsville, Minn.

[21] Appl. No.: 281,368

[22] Filed: Jul. 8, 1981

[51] Int. Cl.[3] ..... A47C 27/10

[52] U.S. Cl. ..... 5/453; 5/455; 5/464; 5/474; 415/121 R; 417/423 R

[58] Field of Search ..... 5/449, 450, 453–456, 5/474, 464; 297/DIG. 3; 417/423 R; 415/121 R

[56] References Cited

U.S. PATENT DOCUMENTS 3,303,518 2/1967 Ingram ..... 5/456
4,078,842 3/1978 Zur ..... 297/DIG. 3
4,224,706 9/1980 Young et al. ..... 5/449
4,306,322 12/1981 Young et al. ..... 5/449

FOREIGN PATENT DOCUMENTS 1529538 3/1970 Fed. Rep. of Germany ..... 5/455

*Primary Examiner*—Alexander Grosz
*Attorney, Agent, or Firm*—Stephenson and Boller

[57] ABSTRACT

A bed or mattress structure having at least one pneumatic bladder confined within an outer perimeter of resilient but relatively firm edging material, with top and bottom covers, wherein air flow tubes are coupled into the penumatic bladder and are connected to an electrically driven blower assembly which intakes and pressurizes ambient air at a moderately elevated pressure to the air bladder; the blower and air flow paths being controllable by at least one hand held control unit.

27 Claims, 8 Drawing Figures

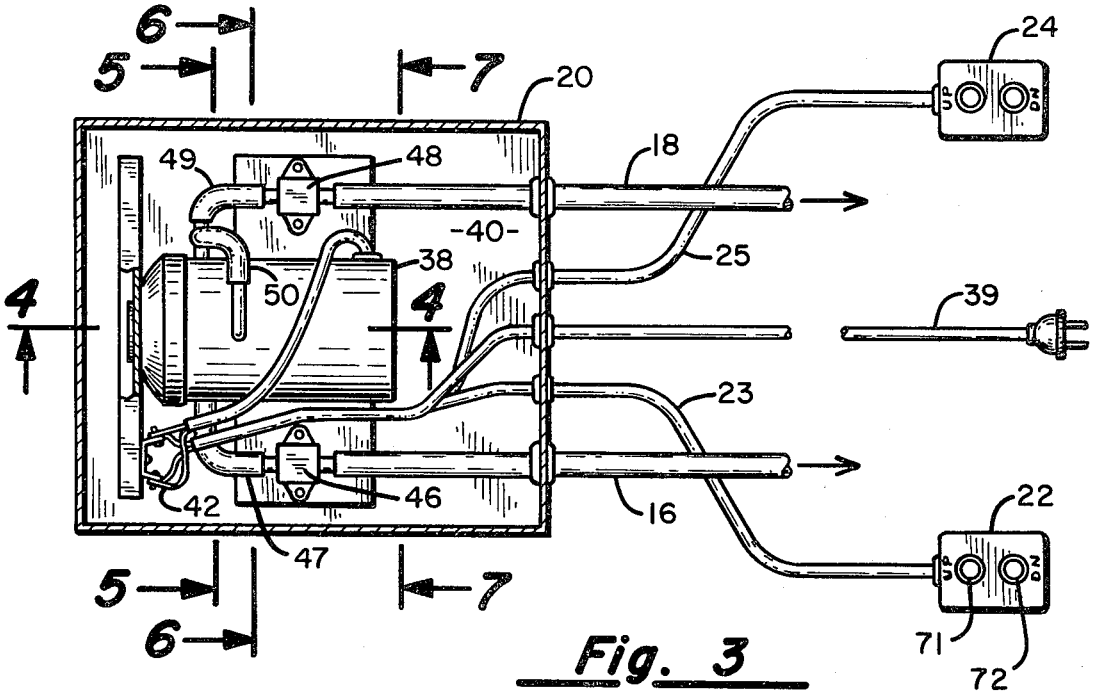
Fig. 3
Fig. 4
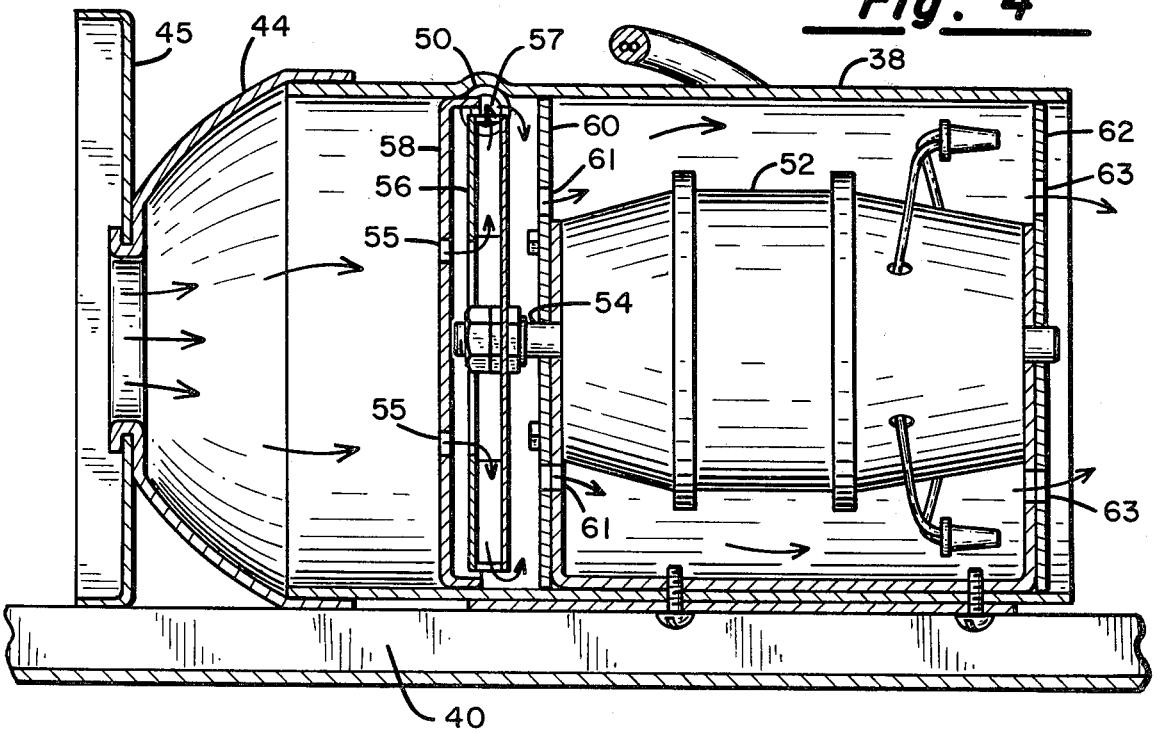

AIR BED WITH FIRMNESS CONTROL

BACKGROUND OF THE INVENTION

The present invention relates to bedding and mattresses, and more particularly to mattresses of a type including pneumatic bladders as an important support element in the construction of the mattress. The invention specifically relates to an apparatus for providing variable firmness control to beds having air mattresses as a structural feature.

Beds utilizing air mattresses as an important and functional component thereof are known in the art. The best and most recent example of such a bed may be found in U.S. Pat. No. 4,224,706, issued Sept. 30, 1980, and U.S. patent application No. 094,347, filed Nov. 14, 1979 now U.S. Pat. No. 4,306,322, both of which are owned by the assignee of the present invention. These beds relate specifically to air beds having a "closed" air system, whereas the present invention relates to an air bed having an "open" air system. By contrast, a "closed" air system in a pneumatic bed assembly incorporates an air mattress of some structure which is coupled through appropriate tubes to an air bladder, wherein a predetermined volume of air is sealably confined by the two air elements. Relative firmness of such a pneumatic bed assembly is achieved by controllably transferring some of the air volume between the mattress and the air bladder, and vice versa, and the patents above referred to achieve this result through a mechanism for controlling the total volume of the air bladder. Such a mechanism requires the confinement of the air bladder in a closed but variable volume, and includes means for increasing and decreasing the confinement volume so as to either permit air to flow from the mattress into the air bladder or to force air from the air bladder into the mattress. When air is released from the air mattress into the bladder the "feel" of the bed becomes softer, and when air is forced from the bladder into the mattress, the "feel" of the bed becomes more firm.

SUMMARY OF THE INVENTION

The present invention utilizes an air mattress assembly of a particular and preferred construction, in combination with an externally energized and powered air pressure source. In a preferred embodiment of the invention the air mattress is constructed in two independent sections, each section having an air tube coupled to a source of air pressure. The source of air pressure is selectively controllable by means of independently operable control mechanisms, which preferably may be hand held, and which permit either an increase in air pressure to a section of air mattress or the release thereof, thereby providing independent adjustment and control of relative firmness of each air mattress section.

It is therefore a principal object of the present invention to provide an air mattress having adjustable control of firmness by means of a control unit which may be operated while lying on the mattress.

It is another object of the present invention to provide variable firmness control for two mattress sections in the same bed.

It is a further object of the present invention to provide firmness control for air mattresses by means of an open air system which derives ambient air and elevates its pressure sufficient to control the system.

BRIEF DESCRIPTION OF THE DRAWINGS

An understanding of the operation and advantages of the invention will become apparent from the following specification, and with reference to the appended drawings, in which:

FIG. 3 is a top view of the power source;

FIG. 4 is a cross-sectional view taken along the lines 4—4 of FIG. 3;

DESCRIPTION OF THE PREFERRED EMBODIMENT

Figure 1:
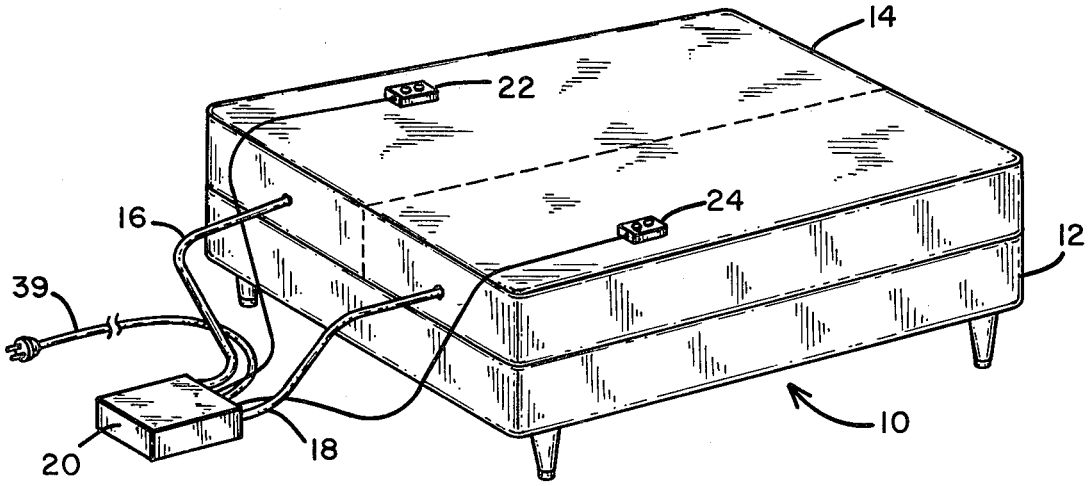
FIG. 1 is a perspective view of a preferred embodiment of the invention.

Referring first to FIG. 1, the preferred embodiment of the invention is shown in perspective view. A bed 10 has a box spring 12 and a mattress 14. Box spring 12 is constructed according to well-known techniques, and mattress 14 is constructed according to the teachings hereinafter recited. A pair of air lines 16 and 18 respectively are coupled to mattress 14, and terminate at power source 20. A pair of control units 22 and 24 are electrically connected to power source 20 and will be hereinafter described. The dotted line shown on FIG. 1, which divides mattress 14 into two halves, is indicative of the construction of the preferred embodiment of mattress 14, wherein each of the mattress halves are independently adjustable relative to firmness.

Figure 2:
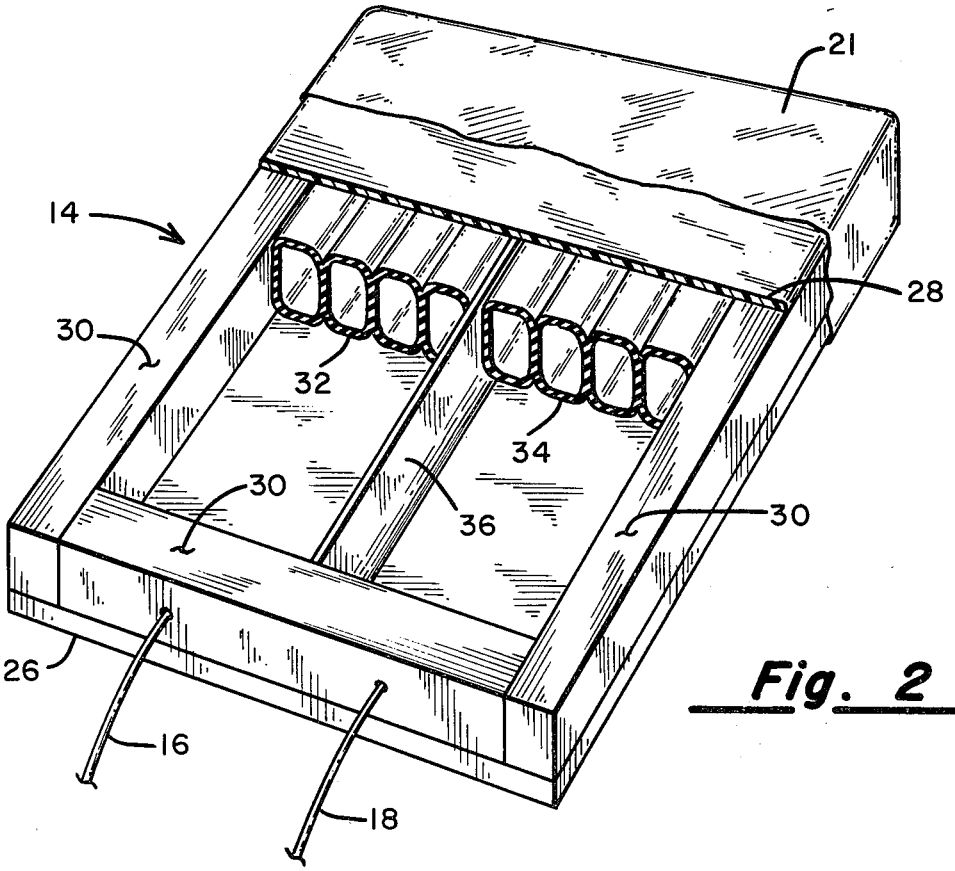
FIG. 2 is a perspective view, partially broken away, illustrating the air mattress of the invention.

FIG. 2 shows a perspective view of mattress 14 in partial breakaway. Mattress 14 has a bottom cover 26 and a top cover 28, one or both of which may be made from soft, padded material. Top cover 28 in particular, may be made in conformance with practices and procedures relating to conventional mattresses, and may be attached to an outer cover 21 over the mattress by means of zippers or other fasteners. An edging material 30 forms an outer perimeter around mattress 14. Edging material 30 is constructed from relatively firm, yet resilient, material such as foam or coil springs confined within a rectangular cover. Edging material 30 may also be constructed from other types of springs or other semiresilient material, with the objective of having resiliency characteristics such that a person sitting on the edge of the mattress will not unduly deform the edging material. It is also important that edging material 30 be sufficiently rigid to confine within its perimeter the air bladder or air bladders which form a part of mattress 14. If edging material 30 is constructed in sections as shown in FIG. 2, it is important that the abutting ends of the respective sections are locked together. This can be accomplished by constructing interlocking mechanisms at the respective section edges, or preferably by enclosing the entire perimeter in a cloth or plastic, tightly fitting cover 21. The edging material 30 is typically approximately four inches in width and five-six inches in height.

At least one air bladder 32 or 34 is contained within the volume defined by edging material 30 and the top and bottom covers 26 and 28. In the preferred embodiment, shown in FIG. 2, an air bladder 32 and an air bladder 34 are positioned in side by side relationship. An intermediate pad or cushion 36 may be used to partially support and separate air bladders 32 and 34, particularly if the curvature of the respective air bladders is semicircular. Each of the air bladders is formed from a plurality of rectangular or cylindrical tubes, with full internal air flow communication between the respective tubes forming the bladder. A port for admitting and exhausting air is affixed at one end of each of the air bladders 32 and 34, and is respectively coupled to air tube 16 and 18. Air tubes 16 and 18 pass through openings in edging material 30 or between edging material 30 and either of the covers 26 or 28, to project and extend externally of mattress 14.

FIG. 3 shows a top view of power source 20 and control units 22 and 24. A blower 38 is affixed to a base 40 and is electrically driven by means of power cord 39. Power cord 39 is connected to a terminal block 42. Blower 38 may be actuated by a signal from control unit 22 via line 23, or by control unit 24 by a signal over line 25. Air line 16 is coupled to a solenoid-operated air valve 46, and air line 18 is coupled to a solenoid-operated air valve 48. Solenoid-operated air valves 46 and 48 are identical in construction, each having a deactivated position wherein the flow of air through respective connected air lines is blocked and an actuated position wherein the flow through the respectively connected air lines is opened. Air valve 48 is coupled to air line segment 49, and air valve 46 is coupled to air line segment 47; segments 47 and 49 are in turn both coupled to air line segment 50 which connects into blower 38.

FIG. 4 is a cross-sectional view taken along the lines 4—4 of FIG. 3. Blower 38 is fitted at its intake end into a housing 44. Housing 44 is attached to wall 45 which forms a structural wall of power source 20. A motor 52 is mounted within blower 38, and a motor shaft 54 is coupled to a blower wheel 56. Blower wheel 56 may be of the construction described herein, or other similar construction, which receives air at inlets 55 proximate its center and centrifugally accelerates the air flow to be released through an outlet 57 proximate its outside circumference. A plate 58 having a plurality of center perforations serves to admit intake air into blower wheel 56. Plate 58 is affixed within blower 38 a short distance upstream from blower wheel 56. A plate 60 is affixed a short distance downstream from blower wheel 56, and has a plurality of openings 61 to permit exhaust air to flow over motor 52. A plate 62 is attached to the downstream end of motor 52, and has a plurality of openings 63 to permit exhaust air to escape from blower 38.

Figure 5:
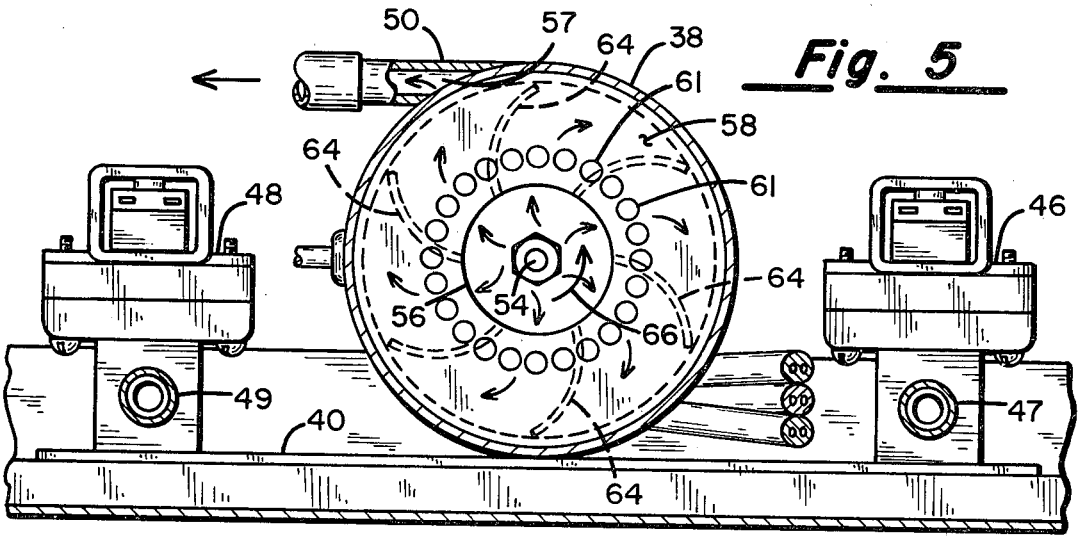
FIG. 5 is a cross-sectional view taken along the lines 5—5 of FIG. 3.

FIG. 5 shows a cross-sectional view taken along the lines 5—5 of FIG. 3. Blower wheel 56 is attached to motor shaft 54 to rotate therewith. Blower wheel 56 has a plurality of blades 64 which preferably are arcuate sections as illustrated in FIG. 5. As blower wheel 56 rotates in the direction shown by arrow 66, intake air received through inlets 55 (see FIG. 4) is accelerated outwardly toward the outer ends of blades 64. Since blower wheel 56 is enclosed within blower 38, the radially outward flow of air is directed to outlet 57, which is tangentially arranged relative to blower 38. The outlet air is therefore directed into air line 50, at a slightly elevated pressure. In the preferred embodiment, the operation of blower wheel 56 causes a pressure increase of 1–2 pounds per square inch (psi). The air passing through air line 50 is therefore 1–2 psi higher pressure than static room air pressure. Air line 50 is coupled into air lines 47 and 49 through a "T" connection (not shown), and air lines 47 and 49 are respectively connected to air valves 46 and 48. Air valves 46 and 48 are commercially available solenoid-operated air valves, such as for example Model UX826089, manufactured by Automatic Switch Company, Florham Part, N.J. 07932. Air valves 46 and 48 are actuated by electrical signals from control units 22 and 24 as will be hereinafter described.

Figure 6:
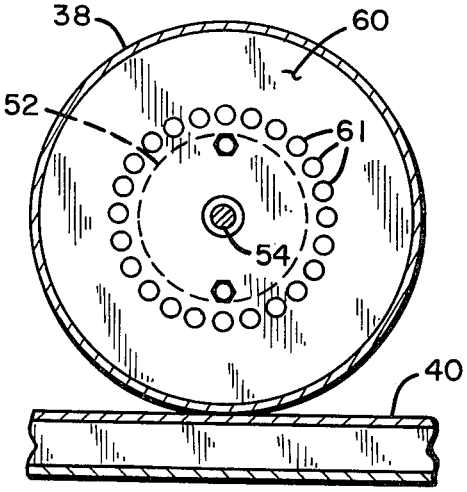
FIG. 6 is a cross-sectional view taken along the lines 6—6 of FIG. 3.

FIG. 6 shows a cross-sectional view of blower 38 taken along the lines 6—6 of FIG. 3. A plate 60 is tightly fitted within blower 38 at a position slightly downstream from blower wheel 56. Plate 60 has a plurality of openings 61 arranged in a circular pattern, the diameter of which is slightly larger than the diameter of motor 52. Openings 61 permit the exhaust of excess air from blower wheel 56, and this exhaust air is directed about the outer casing of motor 52 for cooling purposes.

Figure 7:
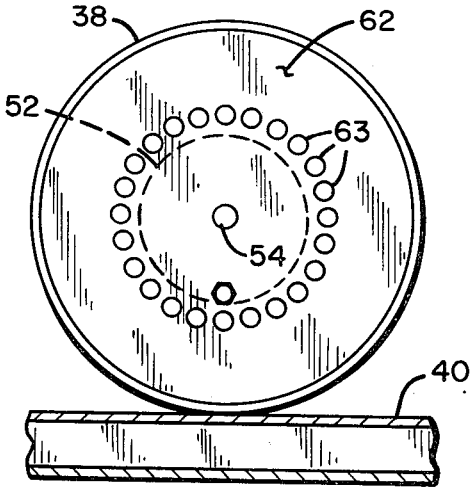
FIG. 7 is a cross-sectional view taken along the lines 7—7 of FIG. 3.

FIG. 7 shows a cross-sectional view taken along the lines 7—7 of FIG. 3. A plate 62 is tightly confined within blower 38 at a position downstream from motor 52. Plate 62 has a plurality of openings 63 arranged in a circular pattern, the diameter of which is slightly larger than the diameter of motor 52, thereby directing a portion of the flow of exhaust air from blower 38 around the outer casing of motor 52.

Figure 8:
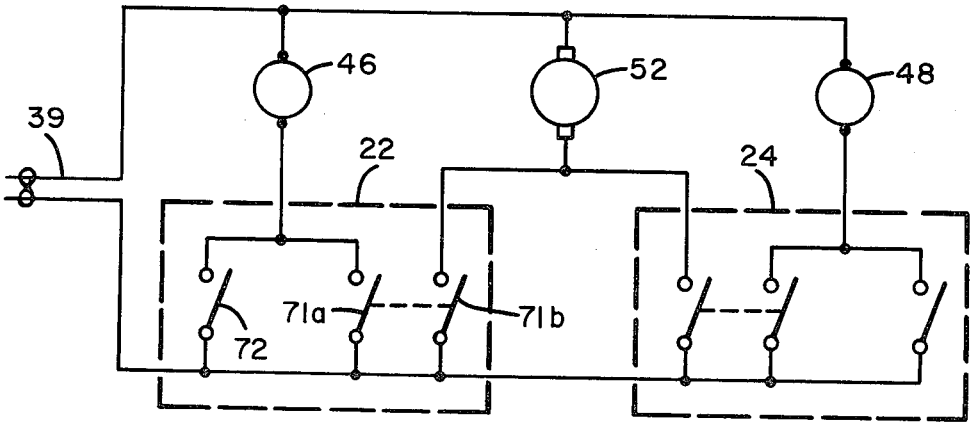
FIG. 8 is a schematic diagram of the control portion of the invention.

FIG. 8 is a schematic diagram of the control portion of the invention. Control units 22 and 24 are of identical construction, and therefore only one control unit will be described by way of example. Control unit 22 comprises a hand held housing having a pushbutton 71 which is mechanically linked to switching elements **71*a* and 71*b*. When pushbutton 71 is depressed both switch elements 71*a* and 71*b* are closed. Pushbutton 71 is labeled "up" or "firm" or similar nomenclature on the external face of control unit 22. The mechanical techniques of construction of pushbutton 71 and switch elements 71*a* and 71*b*** are well within the known prior art and will not be further described herein.

Switch element **71*a* is in series with the electric solenoid coil of air valve 46; switch element 71*b* is in series with the electric motor 52. One side of power line 39 is connected to all of the switching elements described herein, the other side of power line 39 being a common connection respectively to air valve 46, motor 52, and air valve 48. Switch 72 is in series with air valve solenoid 46, and is in parallel connection with switch element 71*a*. Therefore either switch 72 or switch 71*a* may energize solenoid valve 46. Switch 72 is labeled "down" or "soft" or similar nomenclature on the external face of control unit 22. The internal electrical connections of control unit 24 are identical to the internal electrical connections of control unit 22, and therefore a person operating either control unit 22 or control unit 24** may selectively energize either the connected air valve and motor in combination, or the air valve alone, depending upon which control unit pushbutton is depressed.

In operation, a person lying on mattress 14 has access to control unit 22 or 24, depending upon which section of mattress 14 the person is lying. For purposes of example it will be assumed that the person is lying on the mattress section which is controllable by control unit 22. When it is desired to increase the firmness of the mattress section, the pushbutton 71 of control unit 22 is depressed, thereby actuating motor 52 and engaging solenoid valve 48. Solenoid valve 48, when engaged, opens the air flow path from air line 49 to air line 18, and therefore permits pressurized air developed by blower wheel 56 to flow via line 50 to air line 18. The flow of this pressurized air is directed into the air mattress section, and increases the pressure within the connected air bladder. This increase in pressure is sensed by the person lying on the air bladder as an increase in relative firmness of the mattress. In the event the person desires to decrease the firmness of the air mattress section push-button 72 of control unit 22 is depressed. This engages solenoid-operated air valve 48, but does not actuate motor 52. The engagement of solenoid valve 48 causes the air flow path between air line 18 and 49 to open, and provides a relief path for air confined within the air mattress section. This confined air exhausts backward through air line 18, air line 49 and air line 50 into blower 38, thereby reducing the confined air pressure in the air mattress section and giving the sensation of reduced firmness in the air mattress section. As soon as the push-button of control unit 22 is released solenoid valve 48 becomes deactuated and the air flow path is closed.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An air bed system having firmness control of an air bladder confined within a mattress, comprising (a) an air blower having an intake to atmospheric air and having an exhaust to atmospheric air, and having a pressurized air outlet;

(b) an air line connected to said pressurized air outlet and connected to said air bladder;

(c) an air valve interposed in said air line for selectively opening and closing air flow therethrough;

(d) means for actuating said air valve for opening air flow through said air line and for energizing said air blower; and (e) means for actuating said air valve for opening air flow through said air line and for deenergizing said air blower.

2. The apparatus of claim 1, wherein both of said means for actuating further comprises a control unit remotely positionable from said blower and having control switches therein.

3. The apparatus of claim 2, further comprising two air bladders confined within said mattress, each of said air bladders being connected to said blower pressurized air outlet through an independent air valve and means for actuating, and each of said bladders having an independently operable control units associated therewith.

4. The apparatus of claim 3, wherein each of said control units further comprise two switching elements, one switching element being capable of energizing said blower and said air valve to open air flow through said air line, and the other switching element being capable of energizing said air valve to open air flow through said air line without energizing said blower.

5. The apparatus of claim 1, wherein said blower further comprises a cylindrical housing having a center axis on which an electric motor and fan are affixed.

6. The apparatus of claim 5, further comprising a first circlar plate affixed within said housing adjacent said fan said plate having openings proximate the axis of said housing.

7. The apparatus of claim 6, further comprising a second circular plate affixed within said housing intermediate said fan and said motor, said plate having a plurality of openings arranged proximate said motor.

8. The apparatus of claim 7, further comprising a pressurized air outlet tangentially positioned relative to said fan and said housing.

9. The apparatus of claim 8, further comprising a third circular plate affixed in said housing downstream said motor, said plate having a plurality of openings arranged proximate said motor.

10. The apparatus of claim 9, wherein said fan further comprises a plurality of arcuate vanes generally radially directed from said axis.

11. The apparatus of claim 8, wherein both of said means for actuating further comprises a control unit remotely positionable from said blower and having control switches therein.

12. The apparatus of claim 11, further comprising two air bladders confined within said mattress, each of said air bladders being connected to said blower pressurized air outlet through an independent air valve and means for actuating, and each of said bladders having an independently operable control unit associated therewith.

13. The apparatus of claim 12, wherein each of said control units further comprise two switching elements, one switching element being capable of energizing said blower and said air valve to open air flow through said air line, and the other switching element being capable of energizing said air valve to open air flow through said air line without energizing said blower.

14. A pneumatic bed assembly having firmness control of a mattress, comprising (a) a mattress having resilient but relatively rigid perimeter edge material and an enclosed cavity therein;

(b) a pair of pneumatic bladders positioned in side by side relation in said cavity, each of said bladders having an air line coupled thereto and extending outside said perimeter material;

(c) an air valve connected to each of said air lines;

(d) a blower coupled to both of said air valves;

(e) means for actuating said blower and one of said air valves; and (f) means for actuating one of said air valves without actuating said blower.

15. The apparatus of claim 14, further comprising second means for actuating said blower and the other of said air valves, and second means for actuating the other of said air valves without actuating said blower.

16. The apparatus of claim 15, further comprising a resilient separator between said air bladders.

17. The apparatus of claim 15, wherein said blower further comprises a housing enclosing an electric motor and connected fan, said housing having an air intake at one end and an air exhaust at the other end thereof.

18. The apparatus of claim 17, further comprising a first plate within said housing between said fan and said housing air intake, said plate having openings near the center thereof.

19. The apparatus of claim 18, further comprising a second plate within said housing between said fan and said motor, said plate having a plurality of openings proximate said motor.

20. The apparatus of claim 19, further comprising an opening in said housing between said first and second plates and proximate said fan.

21. The apparatus of claim 20, wherein said housing further comprises a cylindrical structure and said housing opening is tangential to said cylindrical structure.

22. The apparatus of claim 15, wherein each of said means for actuating said blower and respective air valves further comprise a control unit remotely positionable relative to said blower.

23. The apparatus of claim 22, wherein said blower further comprises a housing enclosing an electric motor and connected fan, said housing having an air intake at one end and an air exhaust at the other end thereof.

24. The apparatus of claim 23, further comprising a first plate within said housing between said fan and said housing air intake, said plate having openings near the center thereof.

25. The apparatus of claim 24, further comprising a second plate within said housing between said fan and said motor, said plate having a plurality of openings proximate said motor.

26. The apparatus of claim 25, further comprising an opening in said housing between said first and second plates and proximate said fan.

27. The apparatus of claim 26, wherein said housing further comprises a cylindrical structure and said housing opening is tangential to said cylindrical structure.

* * * * *